US011214088B2

(12) United States Patent
Bros et al.

(10) Patent No.: US 11,214,088 B2
(45) Date of Patent: Jan. 4, 2022

(54) REDUCING MARKS IN PRINT AGENTS ON SUBSTRATES

(71) Applicant: HP Indigo B.V., Amstelveen (NL)

(72) Inventors: Ofir Bros, Kiryat Gat (IL); Noam Parvin, Ness Ziona (IL); Nir Mosenson, Ness Ziona (IL); Marc Klein, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 287 days.

(21) Appl. No.: 16/346,275

(22) PCT Filed: Jan. 16, 2017

(86) PCT No.: PCT/EP2017/050828
§ 371 (c)(1),
(2) Date: Apr. 30, 2019

(87) PCT Pub. No.: WO2018/130312
PCT Pub. Date: Jul. 19, 2018

(65) Prior Publication Data
US 2019/0329578 A1 Oct. 31, 2019

(51) Int. Cl.
*B41M 5/00* (2006.01)
*G03G 15/00* (2006.01)

(52) U.S. Cl.
CPC ..... *B41M 5/0011* (2013.01); *G03G 15/6585* (2013.01)

(58) Field of Classification Search
CPC ..... B41M 5/0011
USPC ..... 101/424.2
See application file for complete search history.

(56) References Cited

U.S. PATENT DOCUMENTS

| | | | | |
|---|---|---|---|---|
| 5,535,676 | A * | 7/1996 | Buschulte | B41F 23/06 101/416.1 |
| 6,210,776 | B1 * | 4/2001 | Hill | B41M 1/18 428/187 |
| 8,156,657 | B2 | 4/2012 | Wiener et al. | |
| 8,360,545 | B2 | 1/2013 | Houjou | |
| 10,166,792 | B2 * | 1/2019 | Weingartner | B41J 13/0009 |
| 2010/0154665 | A1 | 6/2010 | DeMoore et al. | |
| 2010/0259589 | A1 * | 10/2010 | Barry | B41J 11/00214 347/102 |

(Continued)

FOREIGN PATENT DOCUMENTS

JP 2014000749 1/2014

OTHER PUBLICATIONS

Tapematic 2PRINT Mini Details, Jul. 13, 2012, < http://www.tapematic.it/CD-DVD-Digital-Printer/2Print-mini-digital-printer/details/7.html >.

(Continued)

*Primary Examiner* — Anthony H Nguyen
(74) *Attorney, Agent, or Firm* — Dierker & Kavanaugh PC

(57) ABSTRACT

In an example, a method includes identifying a contact area of a substrate within which an apparatus will make contact with the substrate and defining a boundary area of the substrate between the contact area and a remaining area of the substrate. Print agent may be printed on the substrate, wherein the print agent is printed at a first coverage in the remaining area, a second coverage less than the first coverage in the contact area; and a gradually reducing coverage across the boundary area from the first to the second coverage.

15 Claims, 4 Drawing Sheets

(56) References Cited

U.S. PATENT DOCUMENTS

2012/0263512 A1 10/2012 Sakai et al.

OTHER PUBLICATIONS

TeslinÂ® Substrate Printing Guide: Offset Lithography, Sep. 8, 2014, < http://www.teslin.com/Home/Resource-Center/Printing-and-Production/Print-Process/Offset-Lithography.aspx >.

* cited by examiner

REDUCING MARKS IN PRINT AGENTS ON SUBSTRATES

BACKGROUND

In printing, print agents such as inks or toners (generally, 'print agents') may be applied to a substrates. Substrates may in principle comprise any material, for example comprising paper, card, plastics, fabrics, or the like.

In some examples, coloured print agents are applied to a substrate, and then transparent or translucent print agents (generally 'coating') may be applied to the substrate on top of the coloured print agents. The transparent or translucent print agents may provide a visual effect, such as a gloss or matt finish, or may be applied to protect the substrate and make it more durable.

BRIEF DESCRIPTION OF DRAWINGS

Non-limiting examples will now be described with reference to the accompanying drawings, in which.

DETAILED DESCRIPTION

In some print apparatus, a pattern of print agent may be printed on a substrate by depositing pigmented print agents, such as inks, toners, or the like, onto the substrate. Following the printing of the pigmented print agent, the print apparatus may then apply a further print agent to the substrate on top of the toner. In some cases, the further print agent may be a coating agent, for example varnish or varnishing ink which may be transparent or translucent. The further print agent may be printed across an entire surface of the substrate. Such coating print agents may have a longer drying time than other print agents.

For the purposes of the present disclosure, the further print agent will be described as a varnish for brevity. Of course, it should be understood that the examples described herein may be equally applicable to other types of print agents.

The print apparatus may allow a varnish drying time, which should elapse after the printing of the varnish to allow the varnish to dry. However, in some cases, the substrate may be moved away from the location of printing before the full drying time has elapsed, for example to make way for a next substrate to be printed. As such, apparatus for moving the substrate after printing which may or may not be a part of the print apparatus, such as a suction cup or gripper, may make contact with the substrate and the varnish before the varnish is dried. This can leave marks in the varnish where contact with the suction cups occurs, which can be visible once the varnish has dried and can spoil the appearance of the printed substrate.

Figure 1:
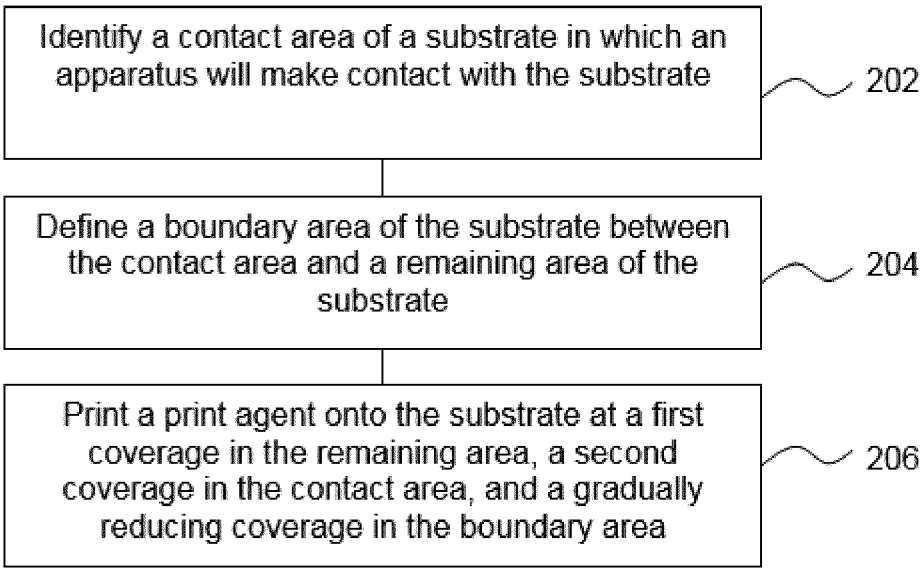
FIG. 1 is a schematic representation of an example method of printing a print agent on a substrate.

FIG. 1 is an example of a method. In some examples method may be a method of reducing marks in a print agent on a substrate. In some examples, the marks may be caused by substrate moving apparatus, such as suction cups or grippers, which contact the substrate after printing the print agent. The substrate moving apparatus may or may not be a part of a print apparatus.

Block 202 comprises identifying a contact area of a substrate within which an apparatus for moving the substrate will make contact with the substrate. In some examples, the apparatus is a suction cup or a gripping tool for moving the substrate after the printing. In some examples, the identifying comprises identifying a plurality of contact areas.

Block 204 comprises defining a boundary area of the substrate between the contact area and a remaining area of the substrate. In some examples, defining the boundary area comprises defining a first edge of the boundary area bordering the remaining area and a second edge of the boundary area bordering the contact area, the boundary area being defined between the first and second edges. In some examples, defining the boundary area comprises defining at least one of the first and second edges as a non-linear edge, or as at least one of jagged, zig-zag, or curved. In some examples, defining the boundary area comprises defining a boundary area coverage proximate the first edge to be substantially similar to the first coverage and defining a boundary area coverage proximate the second edge to be substantially similar to the second coverage. In some examples where a plurality of contact areas are identified, the defining comprises defining a boundary area respective to each contact area identified or defining a boundary area around the plurality of contact areas.

Block 206 comprises printing a print agent on the substrate at a first coverage in the remaining area, at a second coverage less than the first coverage in the contact area, and at a gradually reducing coverage across the boundary area. In some examples, the gradually reducing coverage in the boundary area gradually reduces from the first to the second coverage. In some examples, the gradual reduction may be a progressive reduction or decrease of the coverage. In some examples, the reduction of coverage means that there is not an abrupt change in coverage between the first and second coverages in the boundary area. In some examples where a plurality of contact areas are identified, the printing comprises printing at the second coverage in the plurality of contact areas, and at a gradually reducing coverage in the plurality of boundary areas or the boundary area.

In some examples, the print agent is a transparent or translucent varnish or finishing print agent. In some examples, printing the print agent on the substrate at a gradually reducing coverage across the boundary area comprises printing the coverage across the boundary area to reduce coverage by one of: linearly across the boundary area, in a stepwise manner across the boundary area; or exponentially across the boundary area. In some examples, printing the print agent on the substrate at the first coverage comprises printing at a coverage of approximately 99% or 100%; and printing the print agent on the substrate at the second coverage comprises printing at a coverage of approximately 20% or 0%. In some examples, the second coverage may be any coverage below 99%, for example 90%, 80%, 70%, 60%, 50%, 40%, 30%, or 10%.

In some examples, the printing may comprise two dimensional printing. In examples associated with two dimensional printing, the substrate may be a sheet or web substrate.

In other examples, printing may comprise three dimensional printing, for example for generating an object using three dimensional printing (also termed 'additive manufacturing').

Three dimensional printing or additive manufacturing techniques may generate a three-dimensional object through the solidification of a build material. This may be carried out in a layer-by-layer manner and, in some such examples, a digital model can be processed to generate slices of parallel planes of the model. Each slice may define a portion of a respective layer of build material that is to be solidified or caused to coalesce by the additive manufacturing system. The properties of generated objects may depend on the type of build material and the type of solidification mechanism used. Build material may be deposited, for example on a print bed and processed layer by layer, for example within a fabrication chamber.

In some examples associated with three dimensional printing, the substrate may a layer of build material. In some examples, the build material may be a powder-like granular material, which may for example be a plastic, ceramic or metal powder. Selective solidification may be achieved by selectively applying at least one print agent to the build material, and may be liquid when applied. For example, a print agent which comprises a fusing agent (also termed a 'coalescence agent' or 'coalescing agent') may be selectively distributed onto portions of a layer of build material in a pattern derived from data representing a slice of a three-dimensional object to be generated. The fusing agent may have a composition which absorbs energy such that, when energy (for example, heat) is applied to the layer, the build material coalesces and solidifies to form a slice of the three-dimensional object in accordance with the pattern. In other examples, coalescence may be achieved in some other manner.

In some examples, the method may further comprise printing a pigmented print agent onto the substrate prior to printing the print agent on the substrate. In some examples, the method may further comprise, after printing the print agent on the substrate, moving the substrate by contacting the apparatus with the substrate in the contact area.

Figure 2:
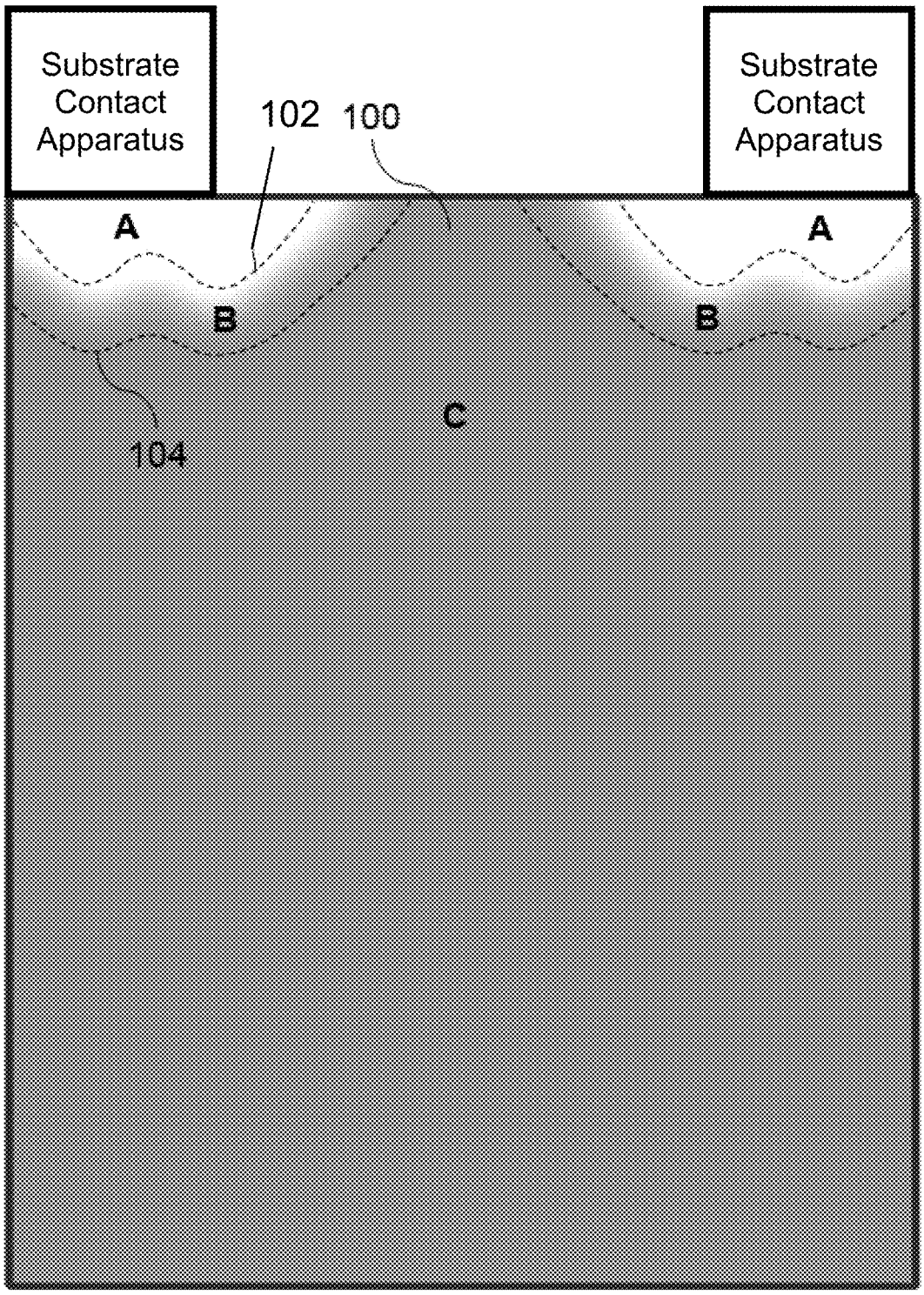
FIG. 2 is an example of a substrate prepared according to an example method.

FIG. 2 shows a substrate 100. For brevity, the substrate moving or contact apparatus will be described herein as a suction cup or cups, but it should be understood that the apparatus may be any other type of apparatus which makes contact with the substrate 100 to move it or handles the substrate 100, such as a gripper element.

Each printer may have predetermined locations on a substrate where the suction cups make contact with the substrate before, during, and after printing. The suction cup may make contact with the substrate at a particular location, and the contact area A may be identified as an area surrounding this location. For example, the contact area A may be identified as an area of the substrate 100 which falls within a predetermined distance of the suction cup contact location. The contact area A identified will include at least the area over which the suction cup will make contact with the substrate 100. The contact area A may also include an area of the substrate 100 around the predicted contact location to allow for deviations between the predicted contact location and the actual contact location. There may be more than one suction cup which will make contact with the substrate 100. If more than one suction cup will make contact with the substrate 100, the contact area A may be identified such that more than one suction cup makes contact with the substrate 100 in the contact area A. In some examples, a separate contact area A may be identified for each suction cup.

In the example substrate 100 of FIG. 2, the contact area is bounded by two sides of the substrate 100 and an edge 102. In this way, the contact area A is formed in a corner of the substrate 100. The substrate 100 has two contact areas A defined in the top left and top right corners of the substrate 100. However, the contact areas A may not be bordered by any edges of the substrate 100 in other examples.

The boundary area B comprises a first edge 102 of the boundary area bordering the remaining area C and a second edge 104 of the boundary area bordering the contact area A. The boundary area B is defined between the first and second edges 102,104. The boundary area B is also bordered by first and second edges of the substrate 100 in the example of FIG. 2. In other examples, the boundary area B may not be bordered by any edges of the substrate 100. It should be understood that the edges 102,104 are not typically printed or marked onto the substrate 100, and are merely identified in order to define the different areas of the substrate 100 for later operations which differ depending upon the area of the substrate 100 in which they occur.

The remaining area C of the substrate 100 is the remaining surface of the substrate 100 which does not fall within the contact areas A or the boundary areas B. Each contact area A has a corresponding boundary area B defined. The boundary area B surrounds the contact area A. In this way, the contact area A and the remaining area C do not share a common edge or border. The boundary area B is defined between the contact area A and the remaining area C to separate them. The boundary area edge 102 in common with the contact area A and the boundary area edge 104 in common with the remaining area C may be spaced apart an equal distance along their respective lengths such that they each form a locus of equidistant points from the other.

In other examples, a distance between the first and second edges 102,104 may be non-constant along their lengths. The perpendicular distance between the first and second edges 102,104 may be referred to as a thickness or width of the boundary area B.

The first and second edges 102,104 of the boundary area B are non-linear. In other examples, the first and second edges 102,104 may be linear or straight line edges. In particular, the first and second edges 102,104 are 'W' shaped edges. They may also be referred to as zig-zag or jagged edges or as being formed of multiple opposing curves. The edges 102,104 are non-parallel and non-perpendicular to the edges of the substrate 100.

The reduced coverage of varnish in the contact area A compared to the remaining area C means that the varnish in the contact area A both dries more quickly, and is less susceptible to being marked by the suction cups when they contact the substrate 100 in the contact area A. Thus, suction cup marks on the substrate 100 may be completely avoided, or the visibility of any suction cup marks which do occur may be reduced.

However, when an abrupt difference in coverage occurs between areas, the difference may be visible and can reduce the aesthetics of the substrate 100. Therefore, the gradual reduction in coverage across the boundary area B avoids an abrupt change in coverage between the contact area A and the remaining area C which would exist otherwise. Thus, the visibility of the reduction in coverage level between the remaining area C and the contact area A is reduced and the substrate 100 maintains aesthetic appeal. Furthermore, if the edges of the boundary area B are non-linear, such as the curved edges 102,104 shown in FIG. 2, the 'blurring' of the reduction in coverage across the boundary area may be further reduced. In particular, as the boundary area is curved and the coverages reduces gradually across its width, the coverage varies in both latitudinal and longitudinal directions on the substrate 100 such that it is difficult to distinguish even the gradual reduction in the coverage of the varnish to the naked eye.

The coverage of the varnish at any given location on the substrate 100 is illustrated using the tone of the substrate 100 in FIG. 2. The darker the tone of the substrate 100, the greater the coverage at that point. Conversely, the lighter the coverage at a given are, the lighter the substrate 100 is shown in that area. Thus, it is clear that the coverage of the varnish varies across the area of the substrate 100.

Coverage is measured in the present example as a percentage (%) of the substrate 100 which is covered by the varnish at that location. For example, 100% coverage would mean that 100% of the area of the substrate 100 having 100% coverage is covered by varnish, and 0% coverage means that no varnish is present. For intermediate coverages, dots of varnish deposited on the substrate 100 are spaced apart to provide the coverage intended. For example, at 50% coverage, dots of varnish are spaced apart on the substrate 100 such that half of the area is covered by dots, and half of the area is not. In other examples, coverage may be measured in dots per inch or the like. The dots of varnish are sufficiently small that they are not visible to the human eye. In other examples, coverage may be defined differently, such as a thickness of varnish applied to the substrate 100, a concentration level of the varnish, or the like.

In the example of FIG. 2, the coverage in the remaining area C is approximately 99%. Thus, the tone of the substrate 100 in the remaining area C represents a coverage of 99%. The coverage in the contact area A is approximately 20%, so the tone in the contact area represents a coverage of 20%. As can be seen in FIG. 2, the tone of the substrate 100 in the boundary area changes from dark to light across the boundary area B from the second edge 104 adjacent the remaining area to the first edge 102 adjacent the contact area. Therefore, the coverage in the boundary area B reduces as the tone of the substrate 100 becomes lighter across its width.

In the example of FIG. 2, the boundary area coverage proximate the edge 102 is substantially similar to the coverage in the contact area A and the boundary area coverage proximate the edge 104 is substantially similar to the coverage in the remaining area. The reduction in coverage across the boundary area may be a linear reduction, i.e. a constant gradient of reduction per unit distance across the boundary area B. In other examples, the reduction may be a reduction in a 'stepwise' manner across the boundary area, i.e. small incremental abrupt or sharp reductions in coverage per unit distance across the boundary area. In other examples, the coverage may reduce exponentially across the boundary area or the like.

In some examples, a plurality of contact areas A may be identified such as the two areas shown in FIG. 2. In some examples, a boundary area B respective to each contact area identified, such as the two boundary areas in FIG. 2. In some examples, the print agent may be printed at the second coverage in the plurality of contact areas, and at a gradually reducing coverage in the plurality of boundary areas.

After printing the print agent on the substrate 100, the substrate 100 may be moved using the suction cup or cups, which make contact with the substrate 100 in the contact area A.

Figure 3:
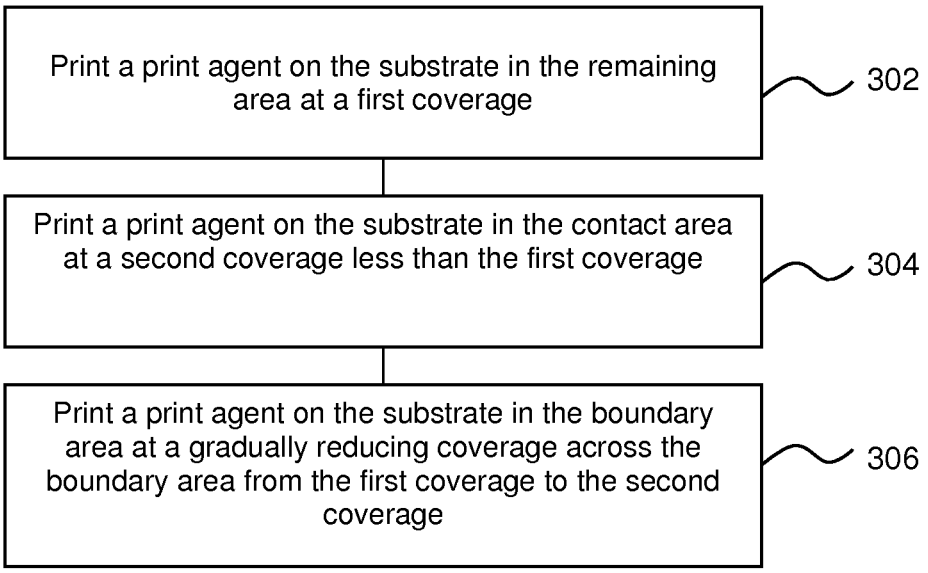
FIG. 3 is a schematic representation of an example of printing.

FIG. 3 shows an example of printing.

Block 302 shows printing a print agent on the substrate in the remaining area at a first coverage. In some examples, the first coverage is 99%. In some examples, the remaining area is the entire area of the substrate which is not in the contact area or the boundary area. In some examples, the remaining area is the remaining printable area of the substrate which is not within the contact area or the boundary area.

Block 304 shows printing a print agent on the substrate in the contact area at a second coverage less than the first coverage. In some examples, the second coverage is 20%. In some examples, the contact area is an area defined around a predicted contact location of an apparatus with the substrate after the printing. In some examples, there may be a plurality of contact areas which are printed during the printing.

Block 306 shows printing a print agent on the substrate in the boundary area at a gradually reducing coverage across the boundary area from the first coverage to the second coverage. In some examples, the boundary area surrounds the contact area such that the contact and remaining areas do not share a common border or edge.

Figure 4:
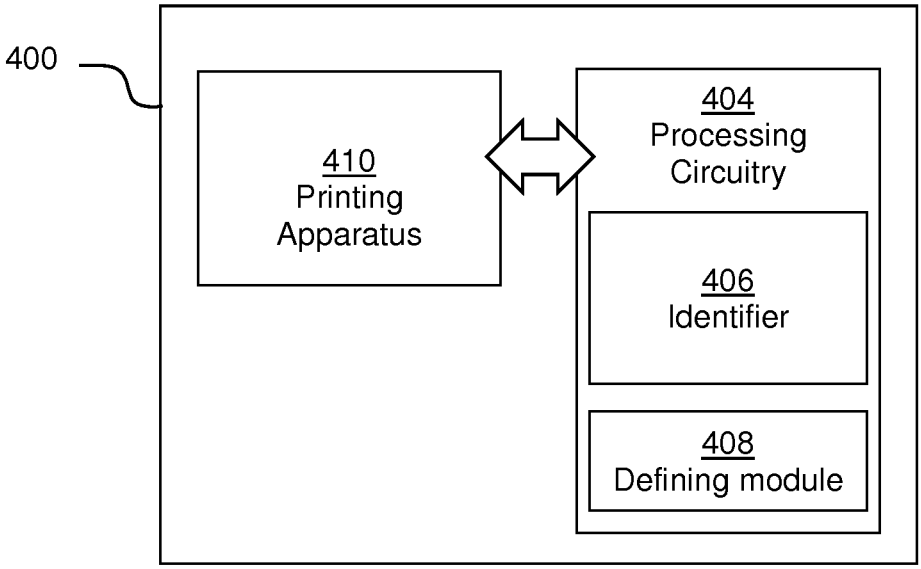
FIG. 4 is an example of a printer system.

In FIG. 4, an example of a printer system 400 is shown. In some examples, the printer system 400 may comprise a two dimensional printer system. In other examples, the printer system 400 may comprised a three dimensional printer system. The system 400 comprises a processing circuitry 404 and printing apparatus 410. The processing circuitry 404 to control the printing of print agents onto a substrate by the printing apparatus 410.

The processing circuitry 404 comprises an identifier 406 to identify the contact area of a substrate within which a substrate contact apparatus, such as a suction cup, will interact with the substrate. The identifier may comprise a predefined location of the contact area which is the same for all substrates, or may contain different locations for the contact area dependent upon the size and shape of the substrate. For example, the contact area may be a contact area A as shown in FIG. 2.

The processing circuitry 404 further comprises a defining module 408 to define the boundary area of the substrate. The defining module may define the boundary area according to a type, shape, or material property of the substrate, or according to a property of the print agent, such as its viscosity, drying time, or thickness on the substrate. For example, the boundary area may be a boundary area B as shown in FIG. 2.

The printing apparatus 410 is to print a print agent on the remaining area at a first coverage, print the print agent on the contact area at a second coverage less than the first coverage; and print the print agent across the boundary area at a progressively decreasing coverage between the first coverage to the second coverage.

In some examples, the printing apparatus 410 may print the print agent (e.g. varnish) according to the method of FIG. 1 as discussed above. The printing apparatus 410 may comprise the contact or handling apparatus for moving the substrate, such as suction cups or grippers. The printing apparatus 410 may comprise a reservoir of print agent, and apparatus for printing the print agent onto the substrate at varying coverages.

Figure 5:
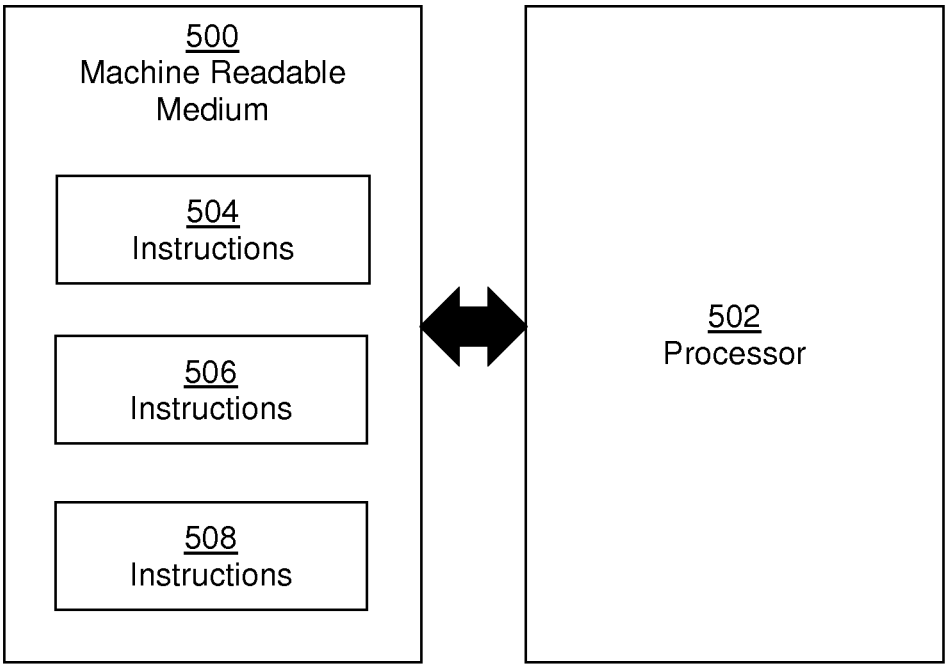
FIG. 5 is an example of a machine readable medium in association with a processor.

FIG. 5 illustrates an example of a non-transitory machine-readable storage medium 500 executable by a processor 502. The machine-readable storage medium 500 is encoded with instructions 504 to identify a handling area of a substrate within which an apparatus will touch the substrate, instructions 506 to define a border area of the substrate between the handling area and a non-handling area of the substrate, and instructions 508 to print a print agent on the non-handling area at a first coverage, print the print agent on the handling area at a second coverage less than the first coverage, and print the print agent across the border area at a gradually decreasing coverage from the first coverage to the second coverage. In other examples, the instructions 504, instructions 506, or instructions 508 may comprise instructions to carry out any part of the method described in FIG. 1.

The instructions 504 may be to cause the processor 502 to identity a contact area, the instruction 506 may be to define a boundary area, and the instructions 508 may be to print a print agent on the substrate. In some examples the instructions may be the identifying, defining, or printing of the method of FIG. 1.

The machine-readable medium 500 and the processor 502 may form part of the printing system discussed in relation to FIG. 4. For example, the processing circuitry 404 may comprise the processor 502 and apparatus for receiving and reading the machine-readable medium 500. The processor 502 may control the identifier 406, the defining module 408, and the printing apparatus 410 to perform the actions laid out in the instructions 504, the instructions 506, and the instructions 508.

Aspects of some examples in the present disclosure can be provided as methods, systems, or machine readable instructions, such as any combination of software, hardware, firmware, or the like. Such machine readable instructions may be included on a computer readable storage medium (including but is not limited to disc storage, CD-ROM, optical storage, etc.) having computer readable program codes therein or thereon.

The present disclosure is described with reference to flow charts and block diagrams of the method, devices, and systems according to examples of the present disclosure. Although the flow diagrams described above show a specific order of execution, the order of execution may differ from that which is depicted. Blocks described in relation to one flow chart may be combined with those of another flow chart. It shall be understood that at least one flow in the flow charts, as well as combinations of the flows in the flow charts can be realized by machine readable instructions.

The machine readable instructions may, for example, be executed by a general purpose computer, a special purpose computer, an embedded processor or processors of other programmable data processing devices to realize the functions described in the description and diagrams, and which may for example comprise at least part of the processing circuitry 404, the identifier 406 or the defining module 408. In particular, a processor or processing apparatus may execute the machine readable instructions. Thus functional modules of the apparatus and devices may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

While the method, apparatus, and related aspects have been described with reference to certain examples, various modifications, changes, omissions, and substitutions can be made without departing from the spirit of the present disclosure. It is intended, therefore, that the method, apparatus, and related aspects be limited only by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A method comprising:

identifying a contact area of a substrate within which an apparatus contacts the substrate;

defining a boundary area of the substrate between the contact area and a remaining area of the substrate; and printing a print agent on the substrate, wherein the print agent is printed at:

(i) a first coverage in the remaining area;

(ii) a second coverage less than the first coverage in the contact area; and (iii) a gradually reducing coverage across the boundary area from the first to the second coverage.

2. A method as claimed in claim 1, wherein the print agent is a transparent or translucent varnish or finishing print agent.

3. A method as claimed in claim 1, wherein defining the boundary area comprises defining a first edge of the boundary area bordering the remaining area and a second edge of the boundary area bordering the contact area, the boundary area being defined between the first and second edges.

4. A method as claimed in claim 3, wherein defining the boundary area comprises defining at least one of the first and second edges as a non-linear edge.

5. A method as claimed in claim 4, wherein defining the boundary area comprises defining at least one of the first and second edges as at least one of: jagged, zig-zag, and curved.

6. A method as claimed in claim 3, wherein defining the boundary area comprises defining a boundary area coverage proximate the first edge to be substantially similar to the first coverage and defining a boundary area coverage proximate the second edge to be substantially similar to the second coverage.

7. A method as claimed in claim 1, wherein printing the print agent on the substrate at a gradually reducing coverage across the boundary area comprises printing the coverage across the boundary area to reduce coverage:

(i) linearly across the boundary area;

(ii) in a stepwise manner across the boundary area; or (iii) exponentially across the boundary area.

8. A method as claimed in claim 1, wherein printing the print agent on the substrate at the first coverage comprises printing at a coverage of approximately 99% or 100%, and printing the print agent on the substrate at the second coverage comprises printing at a coverage of approximately 20% or 0%.

9. A method as claimed in claim 1, wherein the apparatus is a suction cup or a gripping tool for moving the substrate after the printing.

10. A method as claimed in claim 1, wherein:

the identifying comprises identifying a plurality of contact areas;

the defining comprises defining a boundary area respective to each contact area identified or a boundary area around the plurality of contact areas; and the printing comprises printing at the second coverage in the plurality of contact areas, and at a gradually reducing coverage in the plurality of boundary areas or the boundary area.

11. A method as claimed in claim 1, further comprising printing a pigmented print agent onto the substrate prior to printing the print agent on the substrate.

12. A method as claimed in claim 1, further comprising, after printing the print agent on the substrate, moving the substrate by contacting the apparatus with the substrate in the contact area.

13. A method as claimed in claim 1, wherein the method is a method of reducing marks in a print agent on a substrate.

14. A printer system comprising:

a substrate contact apparatus;

an identifier to identify a contact area of a substrate within which the substrate contact apparatus interacts with the substrate;

a defining module to define a boundary area of the substrate between the contact area and a remaining area of the substrate; and a printing apparatus to:

(i) print a print agent on the remaining area at a first coverage;

(ii) print the print agent on the contact area at a second coverage less than the first coverage; and (iii) print the print agent across the boundary area at a progressively decreasing coverage between the first coverage to the second coverage.

15. A non-transitory machine-readable storage medium encoded with instructions executable by a processor, the machine-readable storage medium comprising:

instructions to identify a handling area of a substrate within which an apparatus touches the substrate;

instructions to define a border area of the substrate between the handling area and a non-handling area of the substrate;

instructions to print a print agent on the non-handling area at a first coverage;

instructions to print the print agent on the handling area at a second coverage less than the first coverage; and instructions to print the print agent across the border area at a gradually decreasing coverage from the first coverage to the second coverage.

* * * * *